US006516976B2

(12) United States Patent
Lewis et al.

(10) Patent No.: US 6,516,976 B2
(45) Date of Patent: Feb. 11, 2003

(54) DOSING PUMP FOR LIQUID DISPENSERS

(75) Inventors: Richard P. Lewis, Marietta; Cleary E. Mahaffey, Suwanee, both of GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/741,497

(22) Filed: Dec. 19, 2000

(65) Prior Publication Data

US 2002/0074355 A1 Jun. 20, 2002

(51) Int. Cl.[7] ..... B67D 5/40

(52) U.S. Cl. ..... 222/321.8; 222/181.3; 222/373; 222/380; 222/382; 222/385; 222/209

(58) Field of Search ..... 222/321.8, 181.2, 222/181.3, 372, 373, 380, 382, 383.1, 385, 209

(56) References Cited

U.S. PATENT DOCUMENTS

| | | | | |
|---|---|---|---|---|
| 1,586,398 A | | 5/1926 | Bobrick | |
| 2,184,439 A | | 12/1939 | Schwarcz | |
| 2,545,988 A | | 3/1951 | Bobrick | |
| 2,605,021 A | * | 7/1952 | Churchill et al. | 222/153.03 |
| 2,622,539 A | | 12/1952 | Martin | |
| 2,628,569 A | | 2/1953 | Gilmore | |
| 3,533,526 A | | 10/1970 | Adell | |
| 3,721,370 A | | 3/1973 | Blum | |
| 3,952,918 A | * | 4/1976 | Poitras et al. | 222/181.2 |
| 4,018,363 A | | 4/1977 | Cassia | |
| 4,036,406 A | | 7/1977 | Jespersen et al. | |
| D246,338 S | | 11/1977 | Jespersen | |
| 4,120,619 A | * | 10/1978 | Blackband | 222/321.6 |
| 4,142,651 A | | 3/1979 | Leopoldi et al. | |
| 4,159,788 A | | 7/1979 | Doyel | |
| 4,164,306 A | | 8/1979 | Perrin | |
| 4,166,553 A | | 9/1979 | Fraterrigo | |
| D253,441 S | | 11/1979 | Tucker | |
| 4,174,056 A | | 11/1979 | Leoffler | |
| 4,236,655 A | | 12/1980 | Humphries | |

(List continued on next page.)

FOREIGN PATENT DOCUMENTS

| | | |
|---|---|---|
| DE | 2254386 | 5/1973 |
| EP | 0395380 | 10/1990 |

(List continued on next page.)

OTHER PUBLICATIONS

U.S. application Ser. No. 09/741,570, filed Dec. 19, 2000.
U.S. application Ser. No. 09/821,835, filed Mar. 30, 2001.

(List continued on next page.)

*Primary Examiner*—Lesley D. Morris
*Assistant Examiner*—Stephanie Willatt
(74) *Attorney, Agent, or Firm*—Dority & Manning

(57) ABSTRACT

A dispenser for dispensing metered amounts of a viscous liquid includes a liquid reservoir and a pump chamber having an opening in communication with the reservoir. A dispensing orifice is defined in the pump chamber. A pump mechanism is configured with the pump chamber and is movable from a rest to a pressurizing position upon actuation thereof to pressurize liquid within the pump chamber. A check valve mechanism is disposed in the opening. A restriction device is disposed in the dispensing orifice and maintains a closed configuration to prevent leakage of liquid from the dispensing orifice. The restriction device opens upon sufficient liquid pressure build-up within the pump chamber upon actuation of the pump mechanism. The restriction device also may vent the pump chamber upon release of the pump mechanism.

34 Claims, 10 Drawing Sheets

U.S. PATENT DOCUMENTS

| | | | | |
|---|---|---|---|---|
| 4,248,398 | A | | 2/1981 | Doyel |
| 4,314,658 | A | | 2/1982 | Laauwe |
| 4,330,071 | A | * | 5/1982 | Ohlson ..... 222/207 |
| 4,349,133 | A | | 9/1982 | Christine |
| 4,360,130 | A | * | 11/1982 | Nishimura et al. .... 222/153.09 |
| D268,154 | S | | 3/1983 | Frassanito |
| 4,394,938 | A | | 7/1983 | Frassanito |
| 4,410,109 | A | | 10/1983 | Minard |
| 4,421,254 | A | | 12/1983 | Spector |
| 4,470,523 | A | | 9/1984 | Spector |
| 4,489,857 | A | | 12/1984 | Batlas |
| 4,493,440 | A | | 1/1985 | Von Buelow et al. |
| 4,502,617 | A | | 3/1985 | Stecker et al. |
| 4,519,530 | A | | 5/1985 | Schmidt |
| 4,546,904 | A | | 10/1985 | Frassanito |
| 4,561,571 | A | | 12/1985 | Chen |
| 4,570,833 | A | | 2/1986 | Vanderjagt |
| 4,573,612 | A | | 3/1986 | Maddison et al. |
| 4,621,749 | A | | 11/1986 | Kanfer |
| 4,646,945 | A | | 3/1987 | Steiner et al. |
| 4,650,095 | A | | 3/1987 | Tella et al. |
| 4,660,747 | A | | 4/1987 | Borg et al. |
| 4,662,195 | A | | 5/1987 | Von Buelow et al. |
| 4,673,109 | A | | 6/1987 | Cassia |
| 4,679,709 | A | | 7/1987 | Pointras et al. |
| 4,705,195 | A | | 11/1987 | Heck |
| D299,399 | S | | 1/1989 | Lippman |
| 4,805,814 | A | | 2/1989 | Allen, Sr. |
| 4,811,870 | A | | 3/1989 | Bianco |
| 4,834,269 | A | | 5/1989 | Cone |
| 4,886,192 | A | | 12/1989 | Cassia |
| 4,895,276 | A | | 1/1990 | Maldonado |
| 4,949,877 | A | | 8/1990 | Hanna et al. |
| 4,964,544 | A | | 10/1990 | Hanna et al. |
| D312,184 | S | | 11/1990 | De Luca et al. |
| 4,972,973 | A | | 11/1990 | Davis |
| 4,972,978 | A | | 11/1990 | DeLuca |
| 4,974,753 | A | | 12/1990 | Tucker et al. |
| 4,978,036 | A | * | 12/1990 | Burd ..... 222/181.2 |
| 4,991,747 | A | | 2/1991 | Van Brocklin |
| 4,993,600 | A | | 2/1991 | Tucker et al. |
| 5,042,691 | A | | 8/1991 | Maldonado |
| 5,044,900 | A | | 9/1991 | Cavallaro |
| D321,453 | S | | 11/1991 | Ophardt |
| 5,079,013 | A | | 1/1992 | Belanger |
| 5,131,568 | A | | 7/1992 | Ringuette |
| 5,154,328 | A | | 10/1992 | Gueret |
| 5,165,577 | A | | 11/1992 | Ophardt |
| 5,174,476 | A | | 12/1992 | Steiner et al. |
| D332,544 | S | | 1/1993 | Steiner et al. |
| 5,178,300 | A | | 1/1993 | Haviv et al. |
| 5,183,182 | A | | 2/1993 | Comstock et al. |
| 5,184,760 | A | | 2/1993 | Weinstein et al. |
| 5,186,368 | A | | 2/1993 | Garcia |
| 5,190,191 | A | | 3/1993 | Reyman |
| 5,209,377 | A | | 5/1993 | Steiner et al. |
| 5,213,236 | A | | 5/1993 | Brown et al. |
| 5,217,147 | A | | 6/1993 | Kaufman |
| 5,261,557 | A | | 11/1993 | Bytell et al. |
| 5,265,772 | A | | 11/1993 | Bartasevich et al. |
| D342,176 | S | | 12/1993 | Steiner et al. |
| 5,275,309 | A | | 1/1994 | Baron et al. |
| 5,282,552 | A | | 2/1994 | Ophardt |
| D345,664 | S | | 4/1994 | Brandenburg |
| D345,877 | S | | 4/1994 | Brandenburg |
| 5,303,851 | A | | 4/1994 | Libit et al. |
| 5,305,916 | A | * | 4/1994 | Suzuki et al. ..... 222/181.2 |
| 5,307,962 | A | | 5/1994 | Lin |
| 5,316,135 | A | | 5/1994 | Kneer et al. |
| 5,322,198 | A | | 6/1994 | Ichikawa |
| D349,827 | S | | 8/1994 | Brandenburg |
| 5,339,995 | A | | 8/1994 | Brown et al. |
| 5,339,999 | A | * | 8/1994 | Montesissa ..... 222/148 |
| D350,665 | S | | 9/1994 | Ophardt |
| 5,363,993 | A | | 11/1994 | Mascitelli et al. |
| 5,373,970 | A | | 12/1994 | Ophardt |
| 5,377,877 | A | | 1/1995 | Brown et al. |
| 5,379,919 | A | | 1/1995 | Gueret |
| 5,409,144 | A | | 4/1995 | Brown |
| 5,413,250 | A | | 5/1995 | Gueret |
| 5,413,251 | A | | 5/1995 | Adamson |
| D359,408 | S | | 6/1995 | Frassanito |
| 5,421,489 | A | | 6/1995 | Holzner, Sr. et al. |
| 5,427,279 | A | | 6/1995 | Kaufman |
| 5,429,275 | A | | 7/1995 | Katz |
| 5,431,309 | A | | 7/1995 | Ophardt |
| 5,439,143 | A | | 8/1995 | Brown et al. |
| 5,439,144 | A | | 8/1995 | Holzner |
| 5,443,236 | A | | 8/1995 | Bell et al. |
| 5,452,825 | A | | 9/1995 | Comstock et al. |
| 5,464,125 | A | | 11/1995 | Daansen |
| 5,489,044 | A | | 2/1996 | Ophardt |
| 5,501,372 | A | | 3/1996 | Daansen |
| 5,524,793 | A | | 6/1996 | O'Neill |
| 5,556,005 | A | | 9/1996 | Banks |
| 5,595,324 | A | | 1/1997 | Brown et al. |
| 5,597,097 | A | | 1/1997 | Morris |
| D378,035 | S | | 2/1997 | Ophardt |
| 5,598,952 | A | | 2/1997 | Daansen |
| 5,605,256 | A | | 2/1997 | Fan |
| 5,632,418 | A | | 5/1997 | Brown |
| D379,728 | S | | 6/1997 | Simon |
| 5,638,989 | A | | 6/1997 | Ophardt et al. |
| 5,649,643 | A | | 7/1997 | Ridgeway |
| D383,631 | S | | 9/1997 | Wirt et al. |
| 5,667,105 | A | | 9/1997 | Hartley et al. |
| 5,676,277 | A | | 10/1997 | Ophardt |
| D386,640 | S | | 11/1997 | Wirt et al. |
| 5,687,877 | A | | 11/1997 | Smolen, Jr. |
| D388,990 | S | | 1/1998 | Brandenburg et al. |
| 5,704,522 | A | | 1/1998 | Orgeolet et al. |
| D391,431 | S | | 3/1998 | Brandenburg et al. |
| 5,725,131 | A | | 3/1998 | Bell et al. |
| 5,743,440 | A | | 4/1998 | Da Laforcade |
| D395,774 | S | | 7/1998 | Phillips et al. |
| 5,779,109 | A | | 7/1998 | Gueret |
| 5,799,826 | A | | 9/1998 | Brown et al. |
| 5,799,841 | A | | 9/1998 | Wirt |
| 5,810,203 | A | | 9/1998 | Brennan |
| 5,810,204 | A | | 9/1998 | Devlin et al. |
| 5,816,453 | A | | 10/1998 | Spencer et al. |
| 5,823,397 | A | | 10/1998 | Gil |
| 5,826,755 | A | | 10/1998 | Burd |
| 5,829,640 | A | | 11/1998 | Hershey et al. |
| 5,839,614 | A | | 11/1998 | Brown |
| 5,842,609 | A | | 12/1998 | Higgins et al. |
| 5,842,611 | A | | 12/1998 | Vivier |
| 5,850,948 | A | | 12/1998 | Garcia et al. |
| 5,860,574 | A | | 1/1999 | Shaklin et al. |
| 5,862,956 | A | | 1/1999 | Brandenburg et al. |
| 5,865,352 | A | | 2/1999 | Leary |
| 5,887,762 | A | | 3/1999 | Hanna |
| 5,897,031 | A | | 4/1999 | Wirt et al. |
| 5,899,363 | A | * | 5/1999 | Bliss et al. ..... 222/153.02 |
| 5,908,143 | A | | 6/1999 | Crossdale et al. |
| 5,927,561 | A | | 7/1999 | Foster et al. |
| 5,927,566 | A | | 7/1999 | Mueller |
| 5,927,567 | A | | 7/1999 | Filmore |
| 5,944,227 | A | | 8/1999 | Schroeder et al. |
| 5,944,234 | A | | 8/1999 | Lampe et al. |
| D414,363 | S | | 9/1999 | Daansen |

| | | | | |
|---|---|---|---|---|
| 5,947,338 | A | | 9/1999 | Budsworth et al. |
| 5,971,232 | A | | 10/1999 | Rohr et al. |
| 5,975,360 | A | | 11/1999 | Ophardt |
| 6,016,936 | A | | 1/2000 | Fan |
| 6,026,993 | A | | 2/2000 | Sperna Weiland |
| 6,036,058 | A | | 3/2000 | Chou |
| 6,070,763 | A | | 6/2000 | Gueret |
| 6,076,707 | A | | 6/2000 | Feldner |
| 6,089,410 | A | | 7/2000 | Ponton |
| 6,089,411 | A | | 7/2000 | Baudin et al. |
| 6,112,951 | A | | 9/2000 | Mueller |
| 6,112,952 | A | | 9/2000 | Hess, III et al. |
| 6,119,902 | A | | 9/2000 | Shimada et al. |
| 6,131,773 | A | | 10/2000 | Wade et al. |
| 6,131,806 | A | | 10/2000 | Hess, III et al. |
| 6,152,330 | A | * | 11/2000 | Polan ..... 222/156 |
| 6,186,361 | B1 | | 2/2001 | Teetsel, III |

FOREIGN PATENT DOCUMENTS

| | | | |
|---|---|---|---|
| EP | 0498275 | A1 | 8/1992 |
| EP | 0530789 | B1 | 9/1992 |
| EP | 0659380 | A1 | 6/1995 |
| FR | 2151586 | | 4/1973 |
| FR | 2325346 | | 4/1977 |
| FR | 2653100 | | 10/1989 |
| GB | 2155435 | | 9/1985 |
| NL | 9201928 | | 6/1994 |
| WO | 9716107 | | 5/1997 |
| WO | 9809732 | | 3/1998 |
| WO | 0068038 | | 11/2000 |

OTHER PUBLICATIONS

PCT Search Report–PCT/US01/48975 filed May 21, 2002.
PCT Search Report–PCT/US01/44905 filed Apr. 17, 2002.
EPO Search Report–PCT/US02/05698 filed Jul. 8, 2002.
U.S. Ser. No. 09/911,073 filed Jul. 23, 2001.
U.S. Ser. No. 09/911,361 filed Jul. 23, 2001.
U.S. Ser. No. 09/964,289 filed Sep. 26, 2001.
U.S. Ser. No. 09/964,290 filed Sep. 26, 2001.
U.S. Ser. No. 09/997,278 filed Nov. 28, 2001.

* cited by examiner

DOSING PUMP FOR LIQUID DISPENSERS

FIELD OF THE INVENTION

The present invention relates generally to liquid dispensers, and particularly to a dosing pump for a viscous liquid dispenser.

BACKGROUND OF THE INVENTION

Viscous liquid dispensers are well known in the art for dispensing any manner of viscous liquid, for example lotions, soap, and the like. The conventional dispensers utilize a wide variety of pumping mechanisms which allow a user to depress or manipulate a pump actuator in order to dispense liquid from the dispenser. Exemplary devices are shown, for example, in U.S. Pat. Nos. 5,810,203; 5,379,919; 5,184,760; and 4,174,056.

Conventional dispensers and pump mechanisms are configured generally for vertical mode operation. In other words, the dispenser stands generally upright with the pumping device configured at the top of the unit. These pump devices are generally vented around the stem of the pump and should a user attempt to use the dispenser in a horizontal mode, the dispenser will, in all likelihood, leak around the pump stem.

An additional problem noted with conventional pumps, particularly lotion or soap dispenser pumps, is that there is a tendency for leakage of residual liquid left in the pump head. Certain types of combination pumps, such as peristaltic pumps common to liquid skin care product dispensers, incorporate a spring and ball check valve system in the discharge area to prevent leaking. However, this type of check valve system is relatively expensive and complicated, and the components may be subject to corrosion and/or sticking when used with certain chemical compositions.

Diaphragm type valves are used in certain applications, for example squeeze actuated bottles of hand lotion, in which the bottle is squeezed by a user to provide the liquid pressure required to open the diaphragm valve. However, with these configurations, there is no discreet control over the amount of liquid dispensed.

Thus, there is a need in the art for a dosing pump that can dispense a metered amount of viscous liquid in a horizontal as well as a vertical mode while preventing leakage from around the pump mechanism without complicated check valve devices.

SUMMARY OF THE INVENTION

Objects and advantages of the invention will be set forth in part in the following description, or may be obvious from the description, or may be learned through practice of the invention.

The present invention provides a unique dosing pump that is particularly well suited for viscous liquid dispensers, for example, soap dispensers, lotion dispensers, and the like. The pump may be oriented in a generally horizontal configuration and thus allows greater flexibility as to the design and configuration of a dispenser utilizing the pump.

The pump may be utilized with any manner or shape of dispenser. The dispenser will generally comprise a housing member or members that define a liquid reservoir. The pump includes a pump chamber that is in communication with the liquid reservoir. In one embodiment, the pump chamber may be defined internally of the dispenser housing. For example, the pump chamber may comprise an integrally molded component of the housing. In an alternative embodiment, the pump chamber may be configured on the outside of the reservoir or housing with a channel or passage defining a liquid communication path between the reservoir and the pump chamber. It should be appreciated that any number of configurations may be utilized to define a pump chamber that is in fluid communication with a liquid reservoir.

The pump chamber has a volume that generally defines the metered dose of liquid to be dispensed. A dispensing orifice is defined in the pump chamber. The orifice may be defined in any wall member of the chamber, or in one particular embodiment according to the invention, the orifice may be defined through a pump cylinder.

A pump mechanism is configured with the pump chamber to pressurize liquid within the pump chamber upon actuation of the pump mechanism. The pump mechanism may be any member or configuration of components that pressurizes the liquid contained within the chamber in order to expel or dispense the liquid through the dispensing orifice. In one particular embodiment according to the invention, the pump mechanism includes a pump cylinder that is slidably disposed and retained in the pump chamber. The pump cylinder is moveable from a rest position to a pressurizing position and may be biased to the rest position. An actuator is configured with the pump cylinder and provides a device for an operator to move the pump cylinder to its pressurizing position in order to dispense liquid out the dispensing orifice. The pump mechanism may comprise a shaft and piston type of arrangement wherein the piston is sealed against the chamber walls. Upon movement of the shaft and piston within the pump chamber, any liquid contained within the chamber is pressurized and ultimately dispensed out the dispensing orifice defined in the chamber. The pump mechanism may be a relatively simple diaphragm that pressurizes the pump chamber upon being compressed.

In one embodiment of the invention, the dispensing orifice is defined as a longitudinal channel within a pump cylinder that is slidable within the pump chamber. The channel terminates at a dispensing orifice defined in a delivery end of the cylinder. The pump cylinder may be biased by a spring member towards its rest position. The spring member may be operably configured within the pump chamber or outside of the pump chamber. Any type of resilient member may be utilized to bias the pump cylinder.

The invention is not limited to any particular type of device for actuating the pump. In one particular embodiment, the actuator may comprise a panel member that is pivotally mounted to the dispenser housing. The panel member rests against a front end of a pump cylinder or shaft and thus moves the pump cylinder or shaft upon an operator depressing the panel member. In an alternate embodiment, the actuator may comprise a panel member plate, button or the like attached directly to the front end of the pump cylinder or shaft. The actuator may be configured in any shape to contribute to the aesthetically pleasing look of the dispenser.

A check valve mechanism is operably disposed in the opening between the pump chamber and the liquid reservoir. Upon actuation of the pump, the check valve mechanism moves to seal the pump chamber so that the liquid within the chamber is pressurized. Upon release of the pump actuator, the check valve mechanism moves to unseal the pump chamber so that a metered amount of viscous liquid is able to flow automatically from the reservoir into the pump chamber for dispensing upon the next subsequent actuation of the pump. The check valve mechanism may take on a number of configurations. For example, the check valve mechanism may comprise a ball seated within a recess that defines the opening between the pump chamber and the reservoir. The recess may include a tapered sealing surface against which the ball seals upon actuation of the pump, and a lower recess portion into which the ball falls by gravity upon release of the pump.

In an alternate embodiment, the check valve mechanism may comprise a resilient flap member that is disposed across the opening between the pump chamber and the reservoir. Upon pressurization of the pump chamber, the flap member seals the opening to the reservoir. Upon release of the pump, the flap member hangs freely. The static head pressure of the liquid within the reservoir will move the flap member away from the opening and cause the liquid to refill the pump chamber.

In still another embodiment of the check valve mechanism, a conical plug member takes the place of the ball. The plug member is moveable into and out of engagement with a tapered sealing surface defining the opening in the back of the pump chamber. The plug member may have the general shape of the recess defining the tapered sealing surface, and thus is capable of floating freely within the recess. In an alternate embodiment, the plug member may be guided by a spring loaded rod that is operably connected with the pump piston. The rod may move longitudinally within a recess or channel defined through the piston as the piston and shaft are moved within the pump chamber.

In still another embodiment, the check valve mechanism may comprise an elongated shuttle type valve that is slidable within the opening between the pump chamber and reservoir. The shuttle valve includes a sealing member that seals the opening upon actuation of the pump device. Upon release of the pump, the shuttle valve unseals, and liquid is free to flow past the shuttle valve and into the pump chamber.

The pump according to the invention also includes a restriction device disposed operably across the dispensing orifice. The restriction device is a generally resilient member that opens or moves upon sufficient liquid pressure build up within the pump chamber. Upon release of the pump mechanism, the restriction device serves two purposes. As the pump mechanism, for example the piston and shaft configuration, cylinder, or diaphragm configuration, moves back to its rest position, the restriction device defines a vent path for venting the pump chamber. As the vacuum within the chamber increases upon release of the pump mechanism, the resilient member is drawn towards the pump chamber and thus opens to define a vent path into the chamber. Once the pump mechanism has reached its rest position, the restriction device closes to completely seal the dispensing orifice, and thus, prevents leakage or drippage from the orifice. With the restriction device disposed within the dispensing orifice, it is not necessary to separately vent the pump chamber around the pump shaft or cylinder or to separately vent the dispenser reservoir.

The invention will be described in greater detail below through embodiments illustrated in the figures.

DETAILED DESCRIPTION

Figure 1:
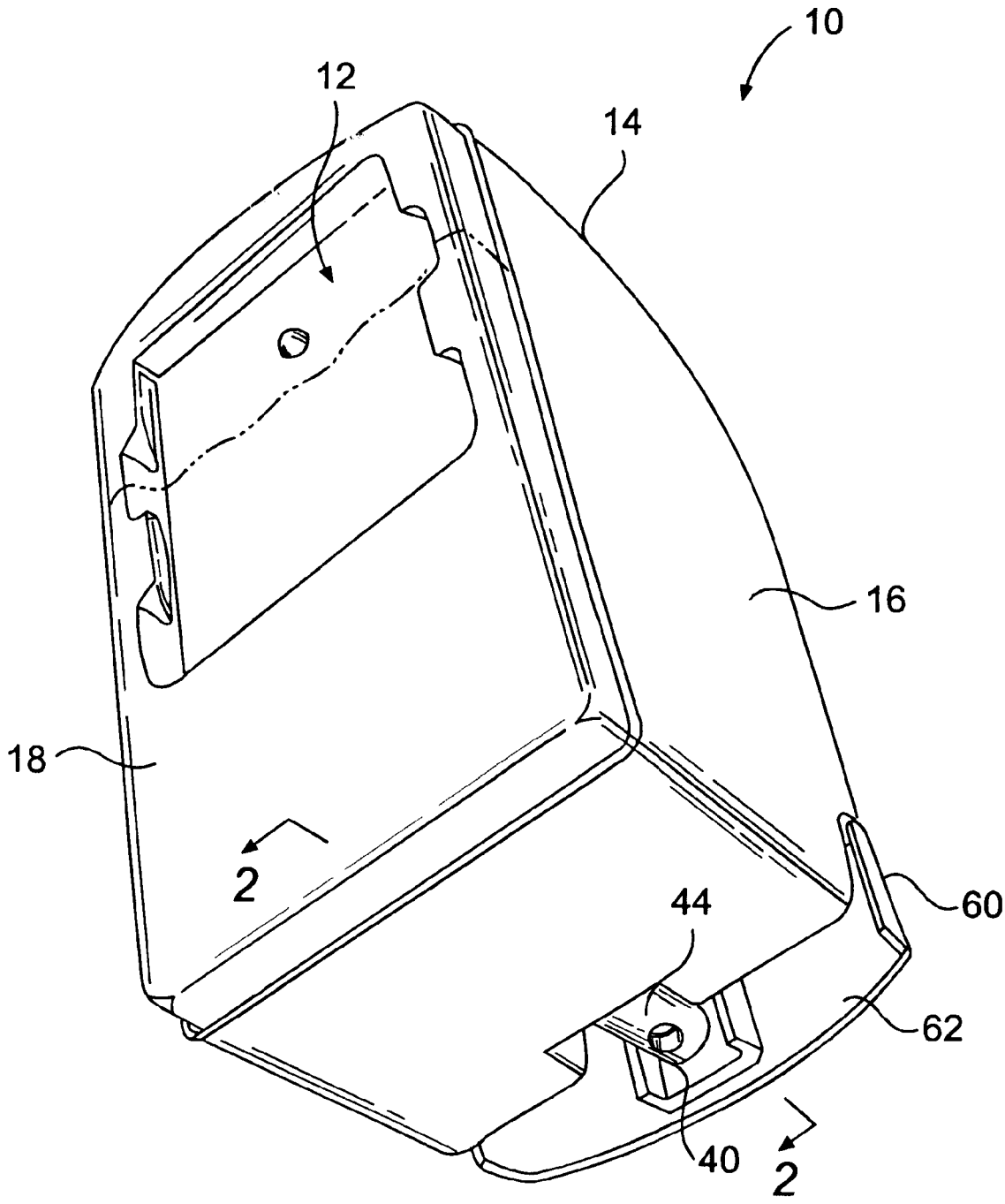
FIG. 1 is a prospective view of a viscous liquid dispenser according to the invention.

Reference will now be made in detail to embodiments of the invention, one or more examples of which are provided in the drawings. Each example is provided by way of explanation of the invention and not meant as a limitation of the invention. For example, features illustrated or described as part of one embodiment may be utilized with another embodiment to yield still a further embodiment. It is intended that the present invention include such modifications and variations as come within the scope of the appended claims and their equivalents.

The present invention relates to a unique dosing pump for use with any manner of liquid dispenser. The pump apparatus is particularly well suited for use with any manner of viscous liquid dispenser, for example soap dispensers, lotion dispenser, and the like. The present invention also encompasses a dispenser utilizing the unique pump according to the invention.

FIG. 1 illustrates a viscous liquid dispenser 10 that is particularly suited as a liquid soap dispenser. The dispenser 10 comprises a housing, generally 14. The housing 14 may comprise any number of components. For example, the housing 14 may include a front housing member 16 that is connected to a back housing member 12. The dispenser 10 illustrated in FIG. 1 is configured as a disposable liquid soap dispenser that can be removably attached to a wall mounted bracket or the like. For this purpose, mounting structure, generally 12, is integrally formed on the back side 18 of the housing 14. The dispenser illustrated in FIG. 1 is described in detail in co-pending and commonly owned U.S. patent application Ser. No. 09/911,073 entitled "Self-Contained Viscous Liquid Dispenser" filed concurrently with this application and which is incorporated herein in its entirety for all purposes.

Figure 2:
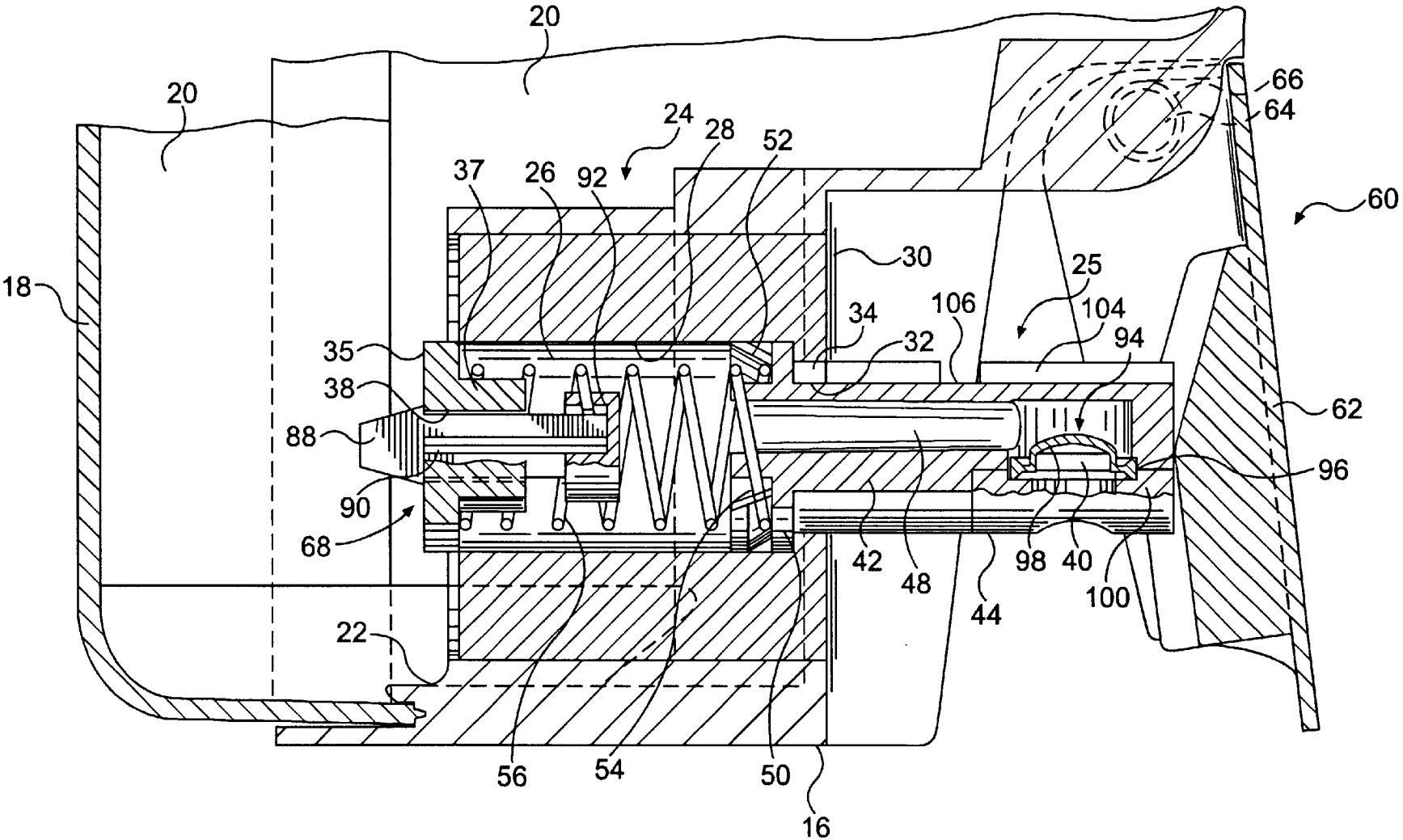
FIG. 2 is a cross sectional view of the pump mechanism taken along the lines indicated in FIG. 1.
Figure 3:
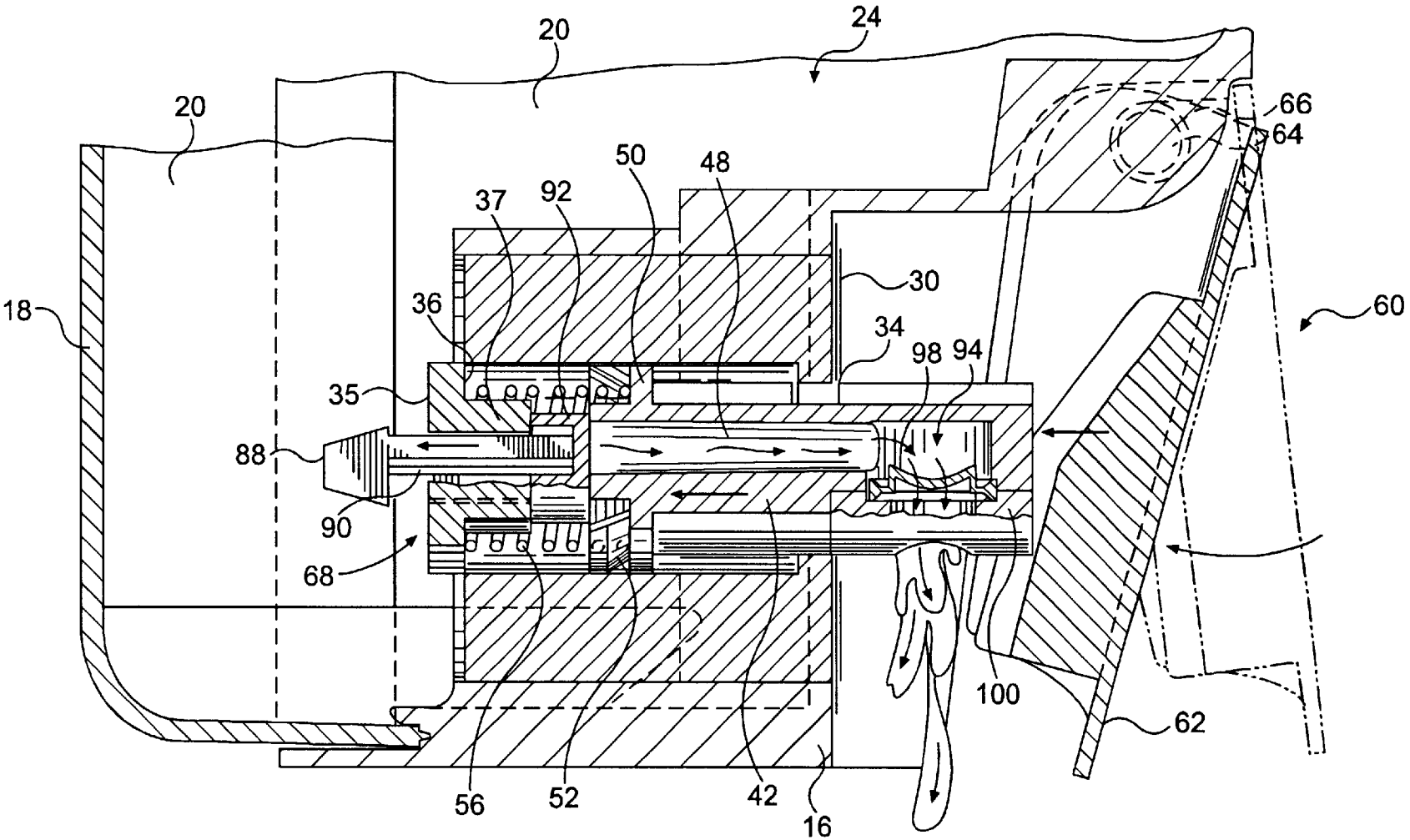
FIG. 3 is a cross sectional operational view of the pump mechanism.
Figure 4:
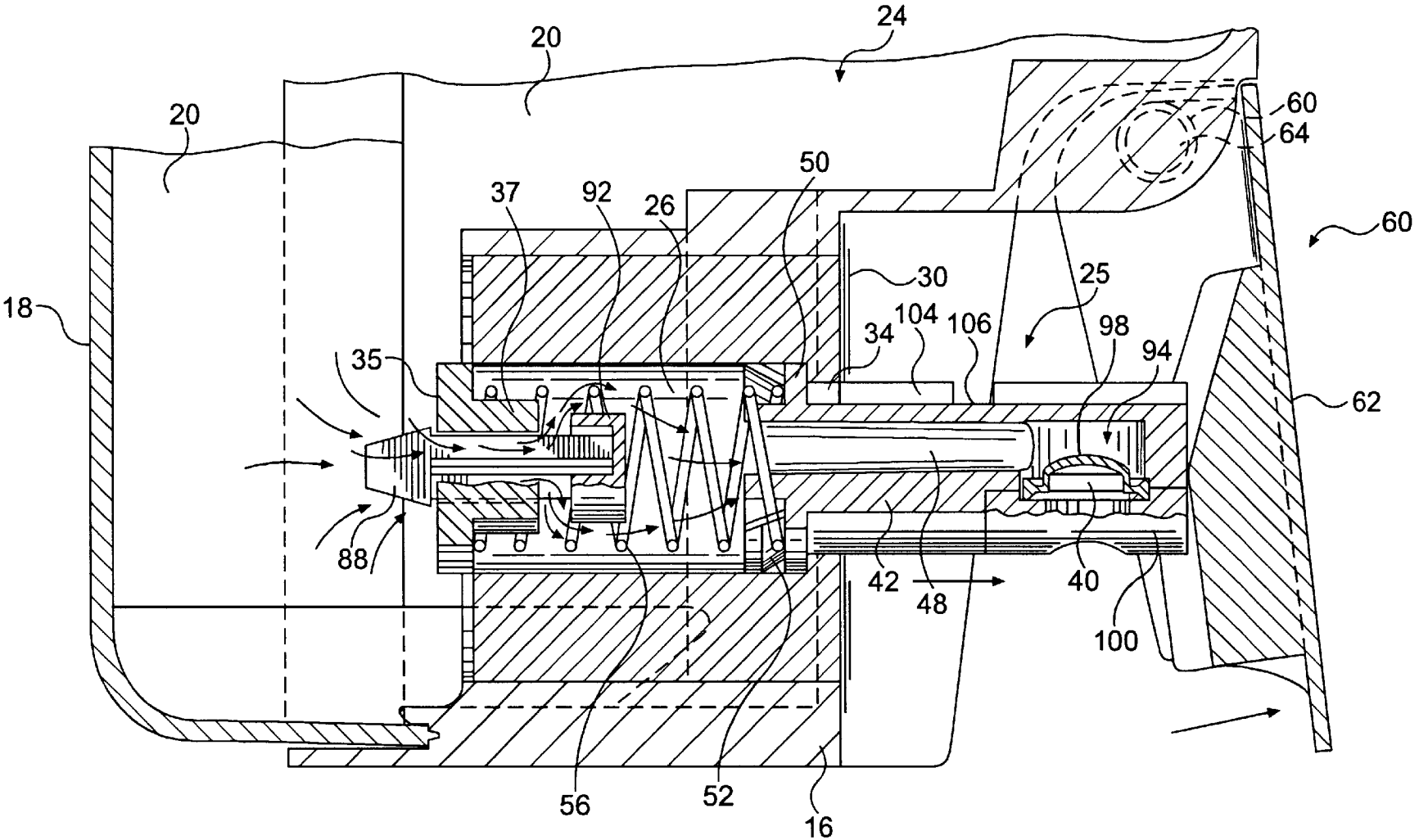
FIG. 4 is a cross sectional operational view of the pump mechanism.

The dispenser 10 includes a liquid reservoir, generally 20 (FIGS. 2–4). A dosing pump is configured with the dispenser to dispense metered doses of the viscus liquid contained within the reservoir 20 upon a user depressing or manipulating a pump actuator. The pump actuator may be any structural member that is configured with or connected to a pump mechanism to dispense the viscus liquid from the dispenser 10. The pump mechanism will be described in greater detail below. In the illustrated embodiments, the pump actuator, generally 60, is illustrated as a panel member 62. The panel member 62 adds to the aesthetically pleasing overall configuration of the dispenser 10 and may take on any shape. The panel member 62 illustrated in FIGS. 1–4 is pivotally attached to the front component 16 of the housing 14 by way of protrusions 64 that reside in recesses 66 defined in the front component 16. In an alternate embodiment illustrated in FIG. 7, the actuator 60 may comprise a panel member 62 that is attached directly to the front of the pump mechanism. In this regard, the actuator 60 may comprise any type of plate, button, cap, or like structure that is directly fixed to the pump mechanism. The actuator 60 need not be connected to the housing 14.

Figure 7:
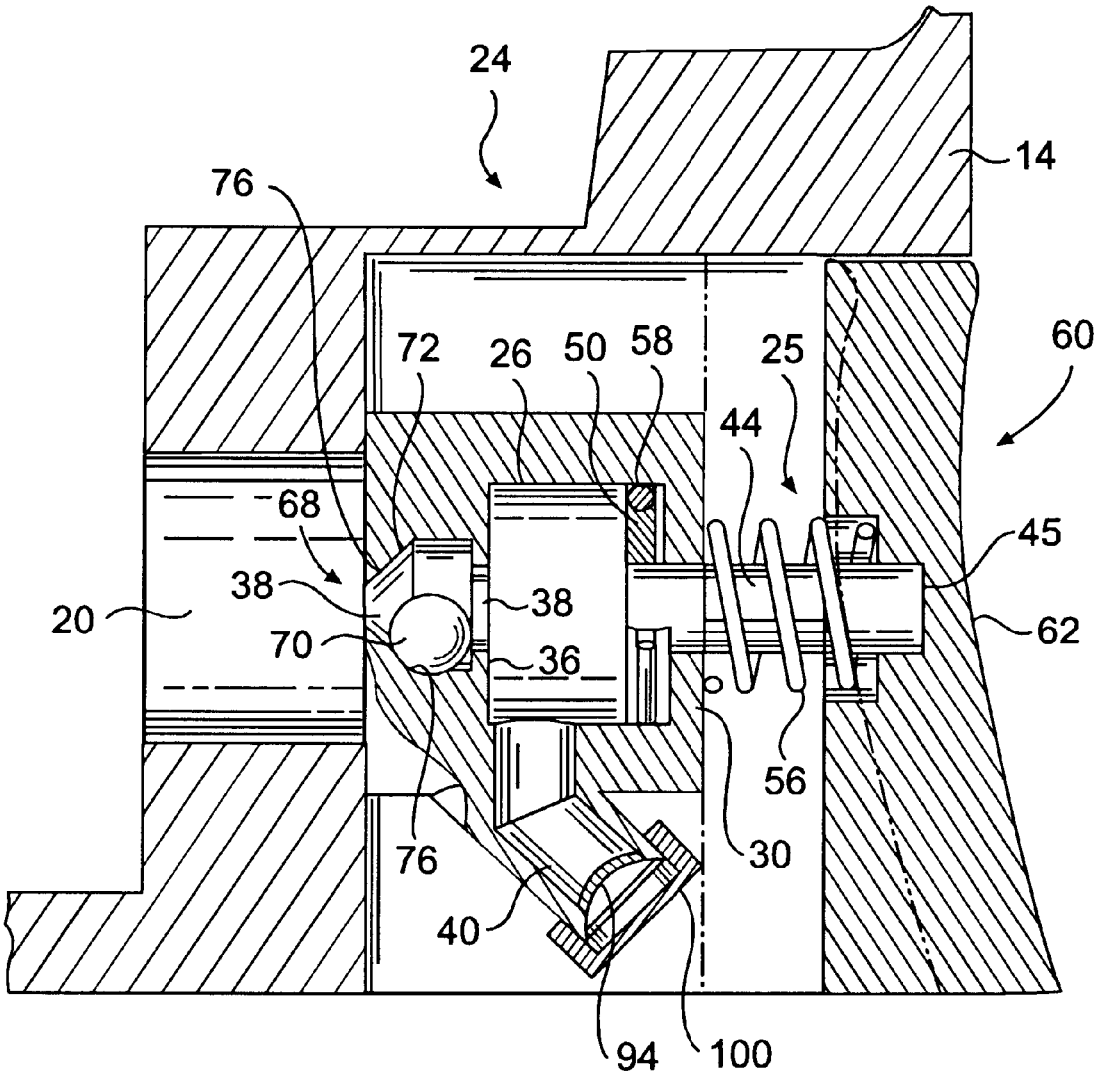
FIG. 7 is a cross sectional view of an alternate embodiment of a pump mechanism according to the invention.
Figure 8A:
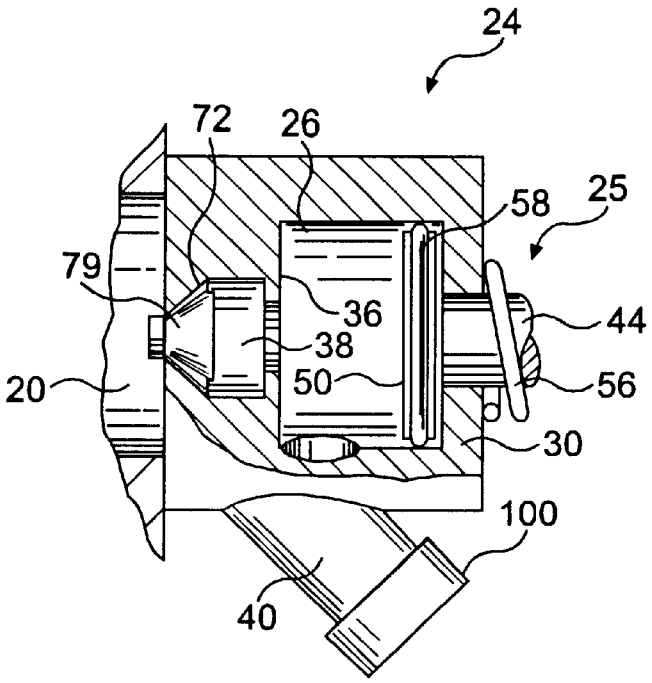
FIG. 8*a* is a cross sectional view of a pump mechanism particularly illustrating a conical plug check valve device.
Figure 8B:
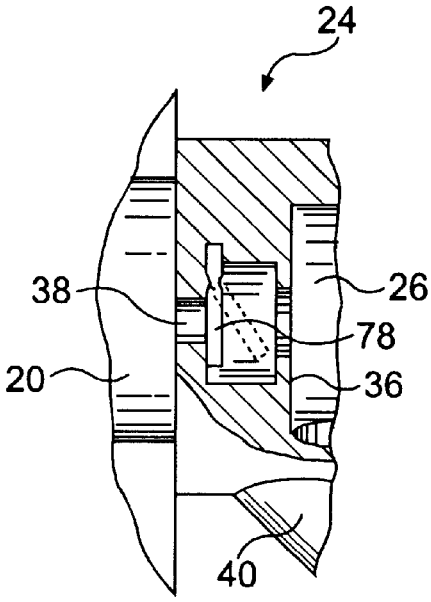
FIG. 8*b* is a cross sectional view of a pump mechanism according to the invention particularly illustrating a flap type of check valve mechanism.

Various embodiments of the dosing pump apparatus 24 are illustrated in the figures. The apparatus 24 includes a pump chamber 26 defined by any manner of structural components. For example, the pump chamber 26 may be defined by wall members that are molded or otherwise formed on an internal surface, i.e., the bottom surface 22 of the housing 14. In this embodiment, the pump chamber 26 is thus disposed completely within the housing 14. In alternate embodiments, for example as illustrated in FIGS. 7–9, the pump chamber 26 is defined by structural wall members that are attached to the outside surface of the housing member 14 by any conventional means. In either case, the pump chamber 26 is in liquid communication with the reservoir 20. For example, the pump chamber 26 may include a back wall 36 having an opening 38 defined therethrough placing the pump chamber 26 in liquid communication with the reservoir 20. In the embodiment of FIGS. 2–4, the back wall of the pump chamber 26 is defined by an end cap member 35 having the opening 38 defined therethrough. This configuration may be used when it is necessary to insert the pump mechanism into the pump chamber 26 prior to sealing the chamber 26.

The pump chamber 26 has an internal volume that essentially defines the metered amount or dose of liquid to be dispensed therefrom. In this regard, the pump chamber can be configured with any desired volume depending on the intended use of the dispenser 10.

A dispensing orifice 40 is also provided in the pump chamber 26 and defines the exit path for the viscous liquid from the pump chamber 26. The dispensing orifice 40 may be defined in any structural member of the pump chamber 26. For example, in the embodiments illustrated in FIGS. 7–9, the dispensing orifice 40 is defined by a channel member in the lower surface of the chamber 26. In the embodiment illustrated in FIGS. 2–4, the dispensing orifice 40 is defined in a member of the pump mechanism, particularly a cylinder 42 that extends through an opening 32 in a front wall 30 of the pump chamber 26. The pump mechanism of FIGS. 2–4 will be described in greater detail below.

As mentioned, the pump apparatus 24 includes a pump mechanism 25 that is operably configured with the pump chamber 26 to pressurize the viscous liquid contained within the pump chamber upon a user actuating the pump mechanism. Various configurations of devices may be utilized in this regard. For example, the pump mechanism 25 may be a cylinder member 42 that is slidable within the pump chamber 26, as illustrated in FIGS. 2–4. The cylinder 42 extends through an opening in the front wall 30 of the pump chamber and is prevented from being pulled out of the chamber 26 by a flange or piston member 50. The piston member 50 also sealingly engages against the walls of the pump chamber 26. An O ring, may be provided on the piston member 50 for this purpose. The cylinder 42 has a longitudinal channel 48 defined therethrough. Channel 48 terminates at the dispensing end of the cylinder 42 at the dispensing orifice 40. Thus, in this embodiment, the dispensing orifice 40 is actually defined in the moveable pump cylinder 42.

The cylinder 42 is moveable between a rest position illustrated in FIG. 2 to a pressurized or dispensing position illustrated FIG. 3. The cylinder 42 is biased to its rest position by any conventional device, for example a spring 56 disposed within the pump chamber 26. The spring 56 has a forward and fitted in a recess 54 defined by a conical flange member 52. The rear end of the spring 56 is fitted around a cylindrical extension 37 of the end cap 35. Referring to FIGS. 2–4, the actuator 60 configured as a panel member 62 is disposed in contact against the forward end of the cylinder 42 so that upon a user depressing the panel member 62 from the front side of the dispenser 10, the cylinder 42 is caused to move rearward within the pump chamber 26, as is operationally depicted in FIG. 3.

Referring to FIG. 3, as the cylinder 42 moves into the pump chamber 26, a check valve mechanism (described in greater detail below) seals the opening 38 in the rear wall 36 of the pump chamber in response to an increase in liquid pressure within the chamber. As the pressure of the liquid increases within the chamber, the liquid is eventually dispensed out of the dispensing orifice 40. In the embodiment of FIGS. 2–4, the liquid is caused to travel through the longitudinal channel 48 to be dispensed out of the dispensing end of the cylinder 42, as illustrated in FIG. 3.

Upon release of the actuator 60, the cylinder 42 is caused to return to its rest position, as illustrated in FIG. 4. As the cylinder moves to the right, a vacuum is drawn within the pump chamber 26 that causes the check valve mechanism to unseat. Liquid from the reservoir 20 is then free to flow into the pump chamber 26 to be dispensed upon the next subsequent actuation of the pump mechanism.

Figure 5A:
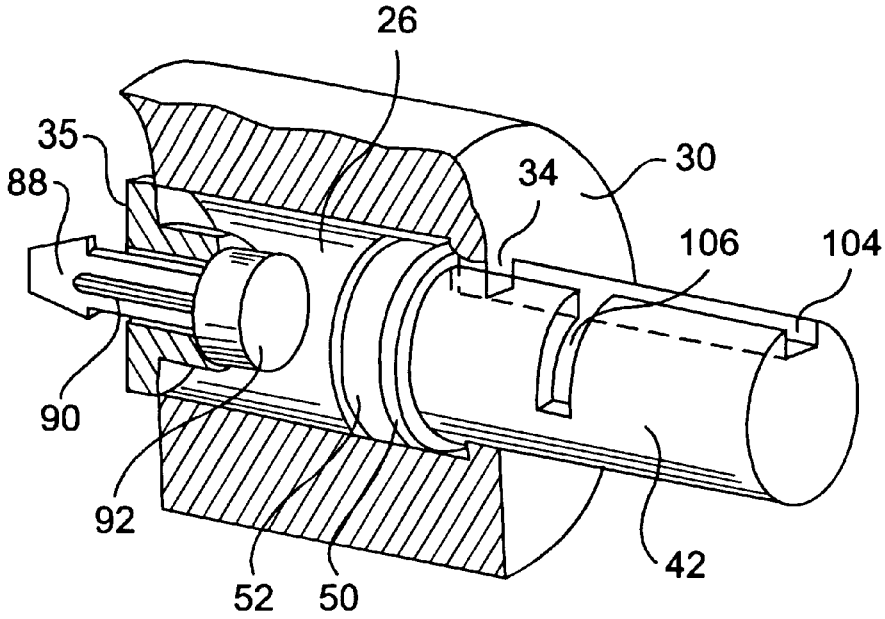
FIG. 5*a* is a partial perspective and cross sectional view of an embodiment of the pump mechanism.
Figure 5B:
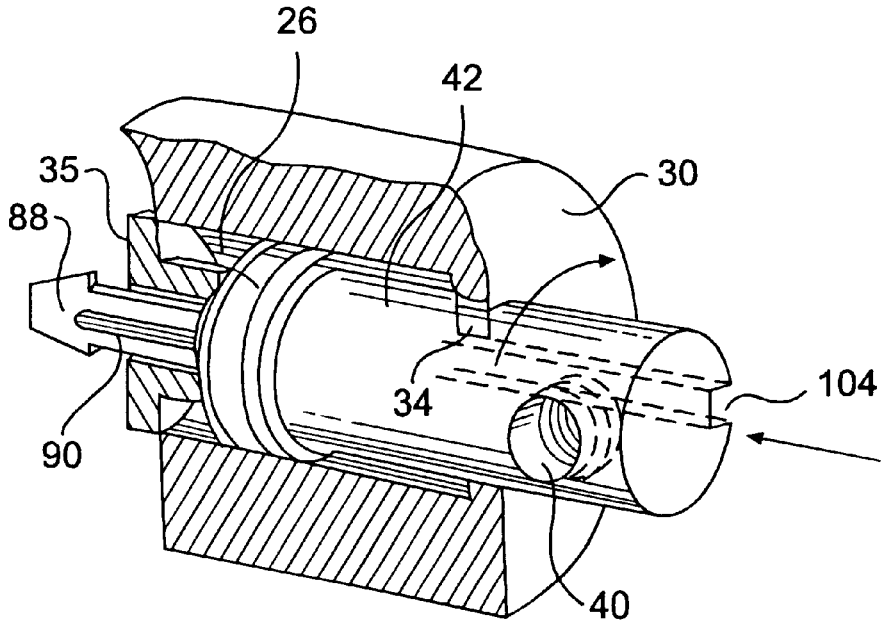
FIG. 5*b* is a partial perspective and cross sectional view of the pump mechanism shown in FIG. 5*a* particularly illustrating a locking feature thereof.
Figure 6A:
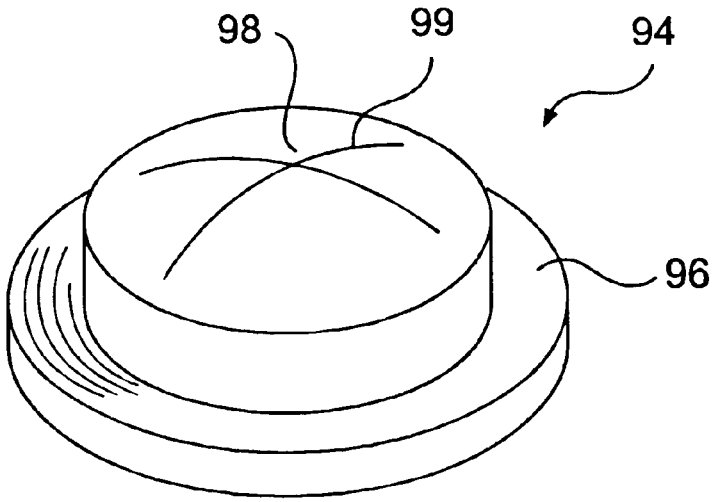
FIG. 6*a* is a perspective view of a restriction device according to the invention.
Figure 6B:
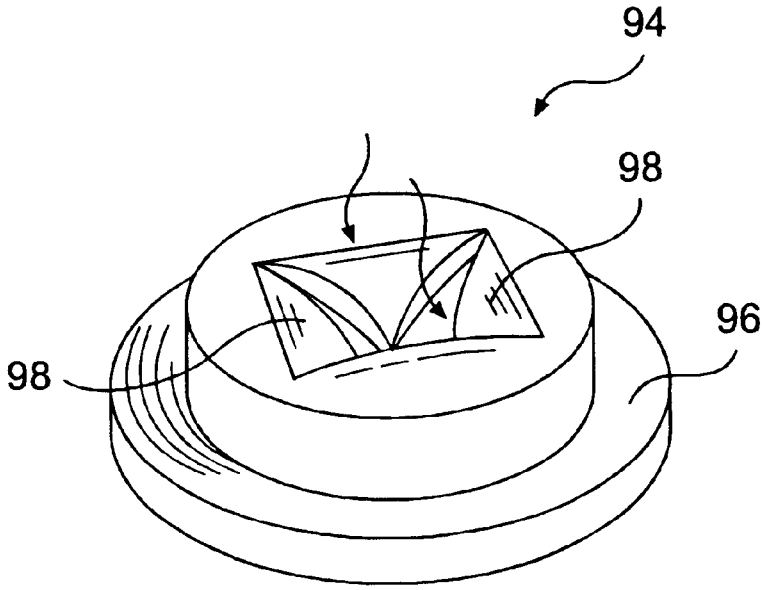
FIG. 6*b* is a perspective operational view of the restriction device illustrated in FIG. 6*a;*

FIGS. 5*a* and 5*b* illustrate a locking feature of the cylinder 42. A longitudinal channel 104 is defined in the top surface of the cylinder 42 and is engaged by a tab 34 of the front wall 30. The cylinder 42 thus slides along the tab 34 upon depression of the actuator and is prevented from rotating in use. The orientation of the dispensing orifice 40 is thus ensured. A partial circumferential groove 106 is also defined in the surface of the cylinder 42. Groove 106 is located at a position that corresponds essentially to the fully depressed position of the cylinder 42. Referring to FIG. 5, once the cylinder 42 has been fully depressed, the cylinder 42 may be rotated and engaged by the tab 34. The cylinder 42 is then locked into position. This locking feature is particularly useful during shipment of the dispenser.

Figure 8C:
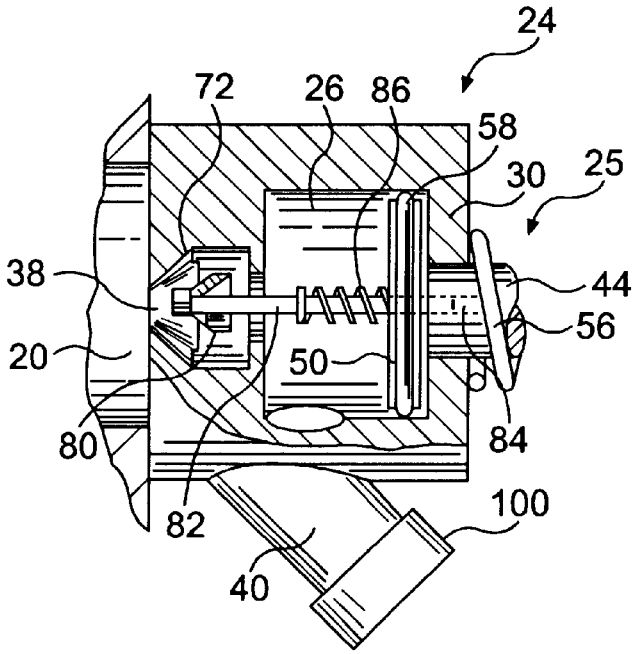
FIG. 8*c* is a cross sectional view of an embodiment of a pump mechanism according to the invention particularly illustrating a plug and rod check valve configuration.
Figure 9:
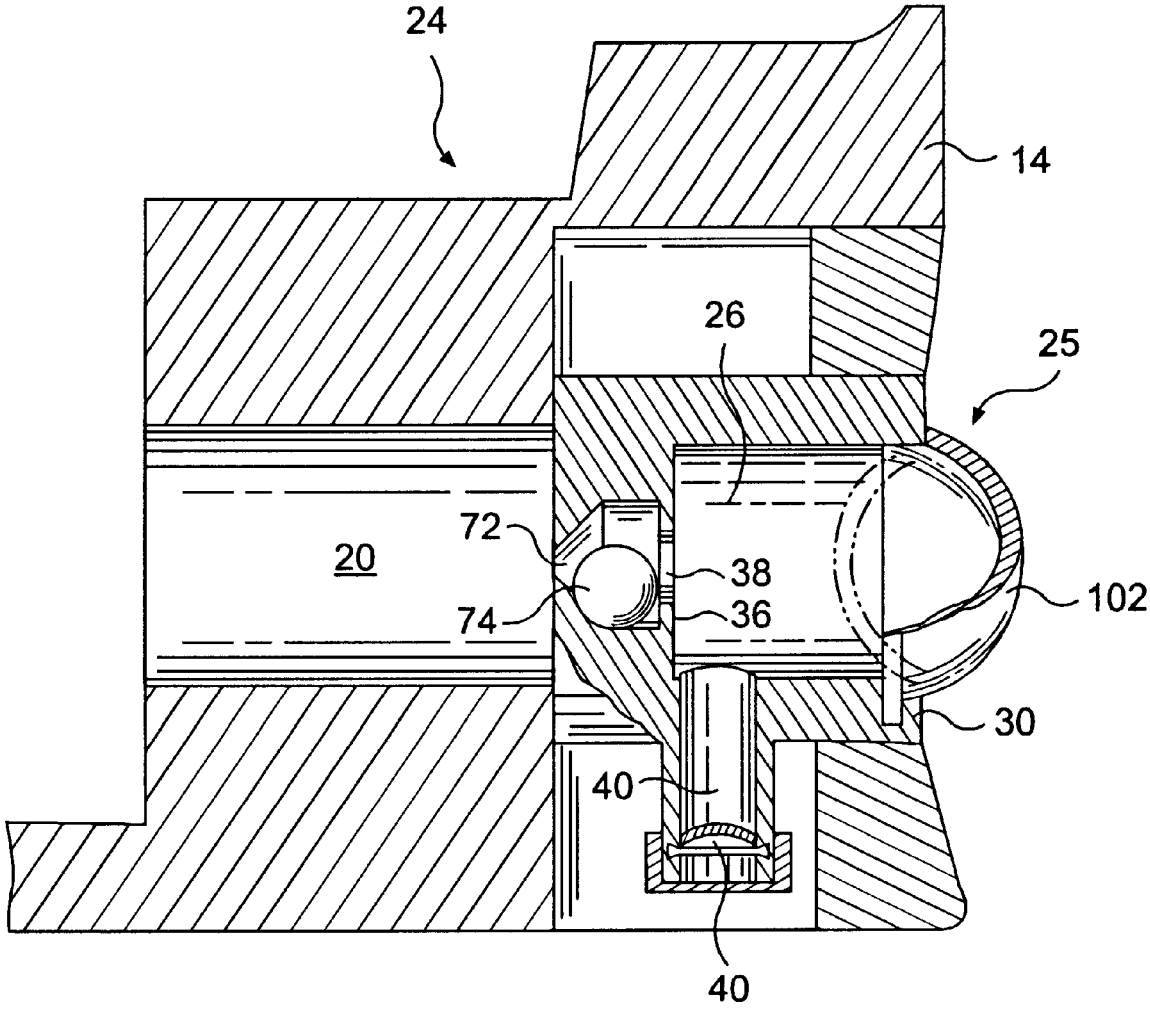
FIG. 9 is a cross sectional view of an alternate embodiment of a pump mechanism utilizing a diaphragm device for pressurizing the pump chamber.

FIGS. 7–8*c* illustrate alternate embodiments of a pump mechanism utilizing a shaft and piston configuration. A shaft 44 extends through an opening of the front wall 30 of the pump chamber 26. The shaft is connected to a piston 50 that moves within the chamber 26 to pressurize the liquid contained therein. An O-ring 58 is provided on the outer circumference of the piston 50 to ensure a sealing engagement against the pump chamber walls. The actuator 60 is connected or in contact against the front of the piston. A spring 56 or other resilient type member is used to bias the shaft and piston to the rest position. It should be noted that, in this embodiment, the spring 56 is disposed outside of the pump chamber 26. Upon depressing the actuator 60, the piston 50 is caused to move into the pump chamber 26 and thus pressurizes the viscous liquid contained therein. The liquid is dispensed through the dispensing orifice 40 defined in a wall of the pump chamber 26.

FIG. 9 illustrates an embodiment of the pump apparatus 24 wherein the pump mechanism 25 comprises a diaphragm 102 for pressurizing the pump chamber 26. The diaphragm 102 also serves as the pump actuator. To operate the device of FIG. 9, a user manually simply depresses the diaphragm 102 inward to pressurize and dispense the liquid within the chamber 26. The ball check valve mechanism operates according to the embodiment of FIG. 7.

As mentioned, a check valve mechanism, generally 68, is operably disposed in the opening 38 between the pump chamber 26 and the reservoir 20 to seal the opening upon actuation of the pump mechanism 25. Various embodiments of the check valve mechanism 68 are illustrated in the figures. Referring to FIGS. 2–5*b*, the check valve mechanism 68 comprises an elongated shuttle valve 88. The shuttle valve 88 is slidable within the opening 38 in the cap member 35 and has a plurality of radially extending arms 90. Liquid from the reservoir 20 is free to flow past the arms 90 and into the pump chamber 26 so long as the shuttle valve 88 is not sealed against the opening 38. Referring to FIG. 3, the shuttle valve 88 includes a cap 92 that sealingly engages against the end cap member 35 upon actuation of the pump mechanism 25. The cap 92 prevents the liquid contained within the reservoir 20 from escaping through the opening in the chamber 26 and back into the reservoir 20 upon actuation of the pump mechanism 25. Upon release of the pump mechanism 25, the shuttle valve 88 moves into the chamber 26 and thus unseals the opening 38, as particularly illustrated in FIG. 4. The static head pressure of the liquid within the reservoir 20 should be sufficient to cause the shuttle valve 88 to unseat and move into the pump chamber 26 to allow the chamber 26 to refill with liquid from the reservoir 20. Unseating of the shuttle valve 88 will be further aided by the vacuum drawn in the chamber 26 upon return of the cylinder 42 to its rest position.

FIG. 7 illustrates an alternate embodiment of the check valve mechanism 68 that utilizes a ball 76 within a recess 72 that also defines the opening or path between the pump chamber 26 and the reservoir 20. The recess 72 includes a tapered sealing section 76 against which the ball 70 is forced upon actuation of the pump mechanism 25. The ball 70 moves into the tapered section 76 and seals the opening 38. Upon release of the pump mechanism 25, the ball will fall by gravity into a lower portion of the recess 72, as illustrated in FIG. 7. Liquid is then free to flow from the reservoir 20 into the pump chamber 26. The static head pressure of the liquid within the reservoir 20 will also aid in unseating the ball 70 from the tapered section 76.

FIG. 8*a* illustrates an embodiment of the check valve mechanism that utilizes a conical member 79 disposed within the recess 72. Upon actuation of the pump mechanism 25, the conical member 79 is forced into engagement against the tapered section 76 of the recess 72 to seal the opening 38. Upon release of the pump mechanism 25, the conical member 79 will move away from the tapered section 76 and thus allow fluid from the reservoir 20 to flow back into the pump chamber 26. The conical member 79 has a general overall shape complimenting that of the recess 72 and is thus able to "float" within the chamber 72.

FIG. 8*b* illustrates an alternate embodiment of the check valve mechanism that utilizes a resilient flap member 78. Upon actuation of the pump mechanism 25, the flap member 78 moves against the chamber and thus seals the opening 38. Upon release of the pump mechanism 25, the flap member 78 is free to move away from the wall, and liquid from the reservoir 20 is free to flow into the pump chamber 26. Again, the static head pressure of the liquid within the reservoir 20 will aid in moving the flap member 78. The increase of vacuum within the chamber 26 will also move the flap member away from the wall.

FIG. 8*c* illustrates an embodiment of the check valve mechanism 68 that incorporates a plug member 80 mounted on a guide rod 82. The guide rod 82 is operably connected to the piston 50 so that the piston physically moves the plug member 80 into engagement against the walls of recess 72. The rod 82 may move within a longitudinal recess 84 defined in the piston 50 and shaft 44. A spring 86 may be provided to bias the plug member 80 away from the piston 50.

The pump apparatus according to the invention also includes a restriction device, generally 94, operably disposed across the dispensing orifice 40. In the illustrated embodiment, the restriction device 94 includes at least one resilient flap member 98, and preferably a plurality of flap members 98 defined by slits 94. Referring particularly to FIGS. 2–4, 6*a*, and 6*b*, the resilient flaps 94 have a concave configuration, and the restriction device 94 is disposed within the dispensing orifice so that the concave flaps are oriented upwards or towards the pump chamber 26. Upon sufficient pressure within the pump chamber 26, the liquid causes the resilient flaps 98 to buckle towards the dispensing orifice 40, as illustrated particularly in FIG. 6*b*, and the liquid flows through the dispensing orifice 40. Upon release of the pump mechanism 25 and return of the mechanism to its rest position, the resilient flaps move back into engagement against themselves. However, due to the vacuum drawn in the pump chamber as the pump mechanism returns to its rest position, the flaps are pulled slightly apart and towards the pump chamber 26. The flaps move apart just enough so that the pump chamber is vented as the pump mechanism 25 returns to its rest position. Once the pump mechanism has returned to its rest position, the flaps 98 again completely seal against each other and prevent leakage or drippage of liquid from the pump chamber.

The restriction device 94 provides a relatively simple means of preventing leakage from the pump chamber, particularly in embodiments of the invention wherein the pump chamber is horizontally disposed at the bottom portion of the pump reservoir where static pressure of the liquid within the reservoir is greatest. The restriction device 94 also provides a relatively simple means for venting the pump chamber 26 and eliminates the need to vent the pump mechanism around the pump shaft or cylinder which may result in leakage problems. Additionally, the pump mechanism may be incorporated with unvented dispensers since a vent path is defined through the pump mechanism.

Figure 10:
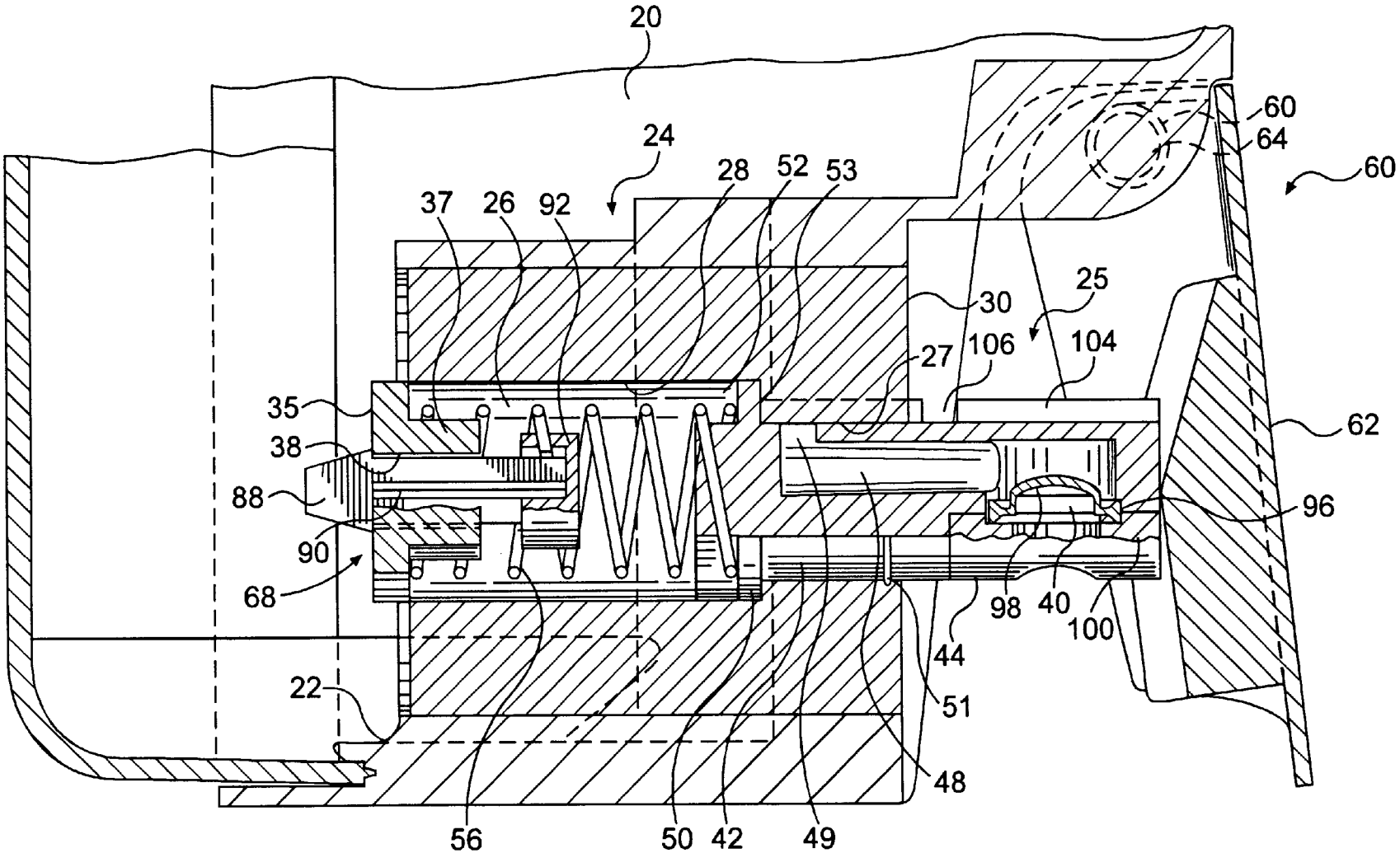
FIG. 10 is a cross sectional view of an alternate embodiment of a pump cylinder and chamber configuration.

FIG. 10 illustrates another embodiment of the dosing pump that is similar in many regards to the embodiment of FIGS. 2–4. However, in this embodiment, the channel 28 defined through the pump cylinder 42 has an inlet 49 defined radially with respect to the channel 48. The pump chamber includes a smaller diameter section 27 "upstream" of the piston member 50 and a wall member 53 against which the piston member 50 engages in the rest position of the pump mechanism. The inlet 49 to the channel 48 is disposed in the chamber section 27 in the rest position of the pump mechanism. The piston member 50 is configured so that viscous liquid within chamber 26 flows through or around the piston member 50 as the cylinder is pushed into the chamber 26. The piston member may include any manner of opening or bypasses for this purpose, but has enough surface area to ensure that the liquid within the chamber 26 is pressurized upon movement of the cylinder 42 into the chamber 26. Upon actuation of the cylinder 42, the cylinder moves into the chamber 26 and the liquid passes into the inlet 49, through the channel 48, and out the dispensing orifice 40. A seal, such as an O-ring 51 is provided around the cylinder 42 upstream of the inlet 49 to seal the chambers 26 and 27. The embodiment of FIG. 10 is useful in that in the rest position of the cylinder 42 as seen in FIG. 10, the smaller diameter chamber 27 is essentially sealed from the larger diameter chamber 26, and thus also from the pressure of the liquid to within the reservoir 20. Thus, the dispensing orifice 40 is essentially isolated from the relatively high static head pressure of the reservoir. Larger reservoir volumes could be used without fear of overcoming the sealing pressure of the restriction device 98 or the seal 51.

It should be appreciated by those skilled in the art that various modification or variations can be made in the invention without departing from the scope and spirit of the invention. It is intended that the invention include such modifications and variations as come within the scope of the appended claims and their equivalents.

What is claimed is:

1. A dispenser for dispensing metered amounts of a viscous liquid, comprising:

a liquid reservoir;

a pump chamber having an opening in communication with said reservoir;

a dispensing orifice in communication with said pump chamber;

a pump mechanism configured with said pump chamber and movable from a rest position to a pressurizing position upon actuation thereof to pressurize liquid within said pump chamber;

an actuator operably connected with said pump mechanism, a check valve mechanism operably disposed in said opening, upon actuation of said pump mechanism said check valve mechanism movable to seal said opening and upon release of said pump mechanism said check valve mechanism movable to unseal said opening wherein a metered amount of viscous liquid flows automatically from said reservoir into said pump chamber for dispensing upon the next subsequent actuation of said pump mechanism;

a restriction device disposed in said dispensing orifice, said restriction device maintaining a closed configuration to prevent leakage of liquid from said dispensing orifice and opening upon sufficient liquid pressure build-up within said pump chamber upon actuation of said pump mechanism; and said restriction device further comprising at least one resilient member movable to a position so as to vent said pump chamber upon release of said pump mechanism and subsequently movable to said closed configuration.

2. The dispenser as in claim 1, wherein said pump mechanism comprises a pump cylinder slidably disposed and retained in said pump chamber, said pump cylinder further comprising a delivery end extending through a front wall of said pump chamber and having a dispensing channel disposed therethrough, said dispensing orifice disposed at a forward end of said dispensing channel.

3. The dispenser as in claim 2, further comprising a biasing element disposed to bias said pump cylinder to said rest position.

4. The dispenser as in claim 2, wherein said dispensing channel comprises an inlet axially aligned with said channel.

5. The dispenser as in claim 1, wherein said pump mechanism comprises a piston slidable within said pump chamber and movable from said rest position to said pressurizing position, and a shaft connected to said piston and extending through a front wall of said pump chamber, said actuator configured at a front end of said shaft.

6. The dispenser as in claim 5, further comprising a biasing element disposed to bias said piston to said rest position.

7. The dispenser as in claim 1, wherein said pump mechanism comprises a diaphragm member disposed across a front wall of said pump chamber, said diaphragm member comprising a front surface that defines said actuator and is depressible by a user to dispense liquid from said dispenser.

8. The dispenser as in claim 1, wherein said dispensing orifice is defined through a lowermost portion of said pump chamber.

9. The dispenser as in claim 1, wherein said pump chamber is disposed on the outside of said reservoir.

10. The dispenser as in claim 1, wherein said pump chamber is disposed at least partially within said reservoir.

11. The dispenser as in claim 10, wherein said reservoir comprises a molded bottom surface, said pump chamber molded integral with said bottom surface.

12. The dispenser as in claim 1, wherein said actuator is pivotally mounted and engaged against said pump mechanism.

13. The dispenser as in claim 1, wherein said actuator is attached directly to said pump mechanism.

14. The dispenser as in claim 1, wherein said restriction device comprises at least one flexible flap member that is movable to an open position upon pressurization of the liquid in said pump chamber and automatically returns to a closed position upon said pump mechanism moving to said rest position.

15. The dispenser as in claim 14, further comprising a plurality of said flap members that define an opening therethrough in said open position and seal against each other in said closed position.

16. The dispenser as in claim 1, wherein said check valve mechanism comprises a ball seated within a recess that defines said opening in said pump chamber, said recess defining a sealing surface against which said ball seals upon pressurization of the liquid within said pump chamber.

17. The dispenser as in claim 1, wherein said check valve mechanism comprises a resilient flap member having one end mounted within said chamber, said flap member disposed across said opening in said pump chamber.

18. The dispenser as in claim 1, wherein said check valve mechanism comprises a conical plug member movable into and out of engagement with said opening in said pump chamber.

19. The dispenser as in claim 18, wherein said plug member is slidable along a guide rod.

20. The dispenser as in claim 1, wherein said check valve mechanism comprises an elongated shuttle valve slidable within said opening in said pump chamber.

21. The dispenser as in claim 1, wherein said pump chamber is vented through said restriction device upon release of said actuator.

22. The dispenser as in claim 1, further comprising a vent disposed in said reservoir.

23. A dosing pump apparatus for dispensing metered amounts of a viscous liquid from a reservoir, said mechanism comprising:

a pump chamber having an opening therein in liquid communication with a liquid reservoir;

a dispensing orifice defined in said pump chamber;

a pump mechanism configured with said pump chamber to pressurize liquid within said pump chamber upon actuation of said pump mechanism;

a check valve mechanism operably disposed in said pump chamber opening and movable upon actuation of said pump mechanism to seal said opening and movable upon release of said pump mechanism to unseal said opening so that a metered amount of liquid flows automatically through said opening into said pump chamber;

a resilient restriction device disposed operably across said dispensing orifice, said restriction device opening upon sufficient liquid pressure build-up within said pump chamber; and said restriction device comprising at least one resilient member movable to a position to vent said pump chamber upon release of said pump mechanism prior to completely closing to seal said dispensing orifice.

24. The pump apparatus as in claim 23, wherein said pump mechanism comprises a pump cylinder slidably disposed and retained in said pump chamber and biased to a rest position, said pump cylinder further comprising a delivery end extending through a front wall of said pump chamber and having a dispensing channel disposed therethrough, said dispensing orifice disposed at a forward end of said dispensing channel.

25. The pump apparatus as in claim 23, wherein said pump mechanism comprises a piston slidable within said pump chamber and biased to a rest position, and a shaft connected to said piston and extending through a front wall of said pump chamber.

26. The pump apparatus as in claim 23, wherein said pump mechanism comprises a diaphragm member disposed across a front wall of said pump chamber, said diaphragm depressible by a user to pressurize and dispense liquid from said pump chamber.

27. The pump apparatus as in claim 23, wherein said dispensing orifice is defined through a lowermost portion of said pump chamber.

28. The pump apparatus as in claim 23, wherein said restriction device comprises at least one flexible flap member that is movable to an open position upon pressurization of the liquid in said pump chamber and automatically returns to a closed position upon said pump mechanism moving to a rest position.

29. The pump apparatus as in claim 28, further comprising a plurality of said flap members that define an opening therethrough in said open position and seal against each other in said closed position.

30. The pump apparatus as in claim 23, wherein said check valve mechanism comprises a ball seated within a recess that defines said opening in said pump chamber, said recess defining a sealing surface against which said ball seals upon pressurization of the liquid within said pump chamber.

31. The pump apparatus as in claim 23, wherein said check valve mechanism comprises a resilient flap member having one end mounted within said chamber, said flap member disposed across said opening in said back end of said pump chamber.

32. The pump apparatus as in claim 23, wherein said check valve mechanism comprises a conical plug member movable into and out of engagement with said opening in said pump chamber.

33. The pump apparatus as in claim 23, wherein said check valve mechanism comprises an elongated shuttle valve slidable within said opening in said pump chamber.

34. A dispenser for dispensing metered amounts of a viscous liquid, comprising:

a liquid reservoir;

a pump chamber having an opening in communication with said reservoir;

a dispensing orifice in communication with said pump chamber;

a pump mechanism configured with said pump chamber and movable from a rest position to a pressurizing position upon actuation thereof to pressurize liquid within said pump chamber;

an actuator operably connected with said pump mechanism;

a check valve mechanism operably disposed in said opening, upon actuation of said pump mechanism said check valve mechanism movable to seal said opening and upon release of said pump mechanism said check valve mechanism movable to unseal said opening wherein a metered amount of viscous liquid flows automatically from said reservoir into said pump chamber for dispensing upon the next subsequent actuation of said pump mechanism;

a restriction device disposed in said dispensing orifice, said restriction device maintaining a closed configuration to prevent leakage of liquid from said dispensing orifice and opening upon sufficient liquid pressure build-up within said pump chamber upon actuation of said pump mechanism;

wherein said restriction device is configured to vent said pump chamber upon release of said pump mechanism;

wherein said pump mechanism comprises a pump cylinder slidably disposed and retained in said pump chamber, said pump cylinder further comprising a delivery end extending through a front wall of said pump chamber and having a dispensing channel disposed therethrough, said dispensing orifice disposed at a forward end of said dispensing channel; and wherein said dispensing channel comprises a radially extending inlet, and said pump chamber comprises a larger diameter section and a smaller diameter section, said inlet disposed within said smaller diameter section in said rest position of said pump cylinder.

* * * * *